US006297604B1

(12) United States Patent
Mao

(10) Patent No.: US 6,297,604 B1
(45) Date of Patent: Oct. 2, 2001

(54) DRAPERY ACTUATOR SYSTEM AND METHOD OF OPERATION

(76) Inventor: Kai Ming Mao, 11 Seagrave Cres, Scarborough, Ontario (CA), M1W 3H6

( * ) Notice: Subject to any disclaimer, the term of this patent is extended or adjusted under 35 U.S.C. 154(b) by 0 days.

(21) Appl. No.: 09/401,773

(22) Filed: Sep. 22, 1999

(51) Int. Cl.[7] ..... H02P 7/00

(52) U.S. Cl. ..... 318/445; 318/286; 160/331

(58) Field of Search ..... 318/445, 280–286, 318/466–468, 65, 66, 9, 10, 16, 17; 160/84.01–84.08, 133, 331, 336, 340, 349.1; D6/578

(56) References Cited

U.S. PATENT DOCUMENTS

| | | | | |
|---|---|---|---|---|
| D. 355,556 | * | 2/1995 | Graham | D6/578 |
| D. 397,899 | * | 9/1998 | Velazquez-Crespo | D6/578 |
| 970,380 | | 9/1910 | Monson . | |
| 1,828,678 | * | 10/1931 | Peterman et al. . | |
| 2,256,008 | * | 9/1941 | Amstrong | 156/46 |
| 2,272,656 | * | 2/1942 | Byron | 156/33 |
| 2,626,375 | * | 1/1953 | Fischer | 318/67 |
| 2,954,224 | | 9/1960 | Schneider | 268/59 |
| 3,117,767 | | 1/1964 | McLean et al. | 254/175.3 |
| 3,237,261 | * | 3/1966 | Homonoff | 24/150 |
| 3,468,061 | | 9/1969 | Ozaki | 49/360 |
| 3,602,286 | | 8/1971 | Hachtel | 160/344 |
| 3,653,091 | | 4/1972 | McKenna et al. | 16/94 |
| 3,688,139 | | 8/1972 | Yaguchi | 310/50 |
| 4,031,944 | * | 6/1977 | Morrison et al. | 160/331 |
| 4,091,973 | * | 5/1978 | Crothers et al. | 223/28 |
| 4,131,831 | | 12/1978 | Bochenek | 318/282 |
| 4,347,450 | | 8/1982 | Colligan | 310/50 |
| 4,481,998 | | 11/1984 | Strandberg et al. | 160/344 |
| 4,610,294 | * | 9/1986 | Anesi et al. | 160/331 |
| 4,852,628 | * | 8/1989 | Klein | 160/199 |
| 4,914,360 | | 4/1990 | Hsieh et al. | 318/16 |
| 4,926,922 | * | 5/1990 | Shimazaki | 160/331 |
| 4,955,422 | | 9/1990 | Irizarry | 160/344 |
| 4,958,112 | | 9/1990 | Zerillo | 318/280 |
| 4,958,377 | | 9/1990 | Takahashi | 382/34 |
| 5,242,006 | | 9/1993 | Ortega | 160/344 |
| 5,273,096 | | 12/1993 | Thomsen et al. | 160/84.1 |
| 5,301,733 | * | 4/1994 | Toti | 160/84.1 |
| 5,391,967 | | 2/1995 | Domel et al. | 318/254 |
| 5,392,562 | | 2/1995 | Carámbula | 49/346 |
| 5,889,377 | | 3/1999 | Mao | 318/466 |

* cited by examiner

*Primary Examiner*—Robert E. Nappi
*Assistant Examiner*—Rina I. Duda
(74) *Attorney, Agent, or Firm*—Gowling Lafleur Henderson; D. Doak Horne

(57) ABSTRACT

A drapery opening and closing system for opening and closing a single drape or two drapes, and a method of opening and closing a drape. A reversible electric motor, to which a winch member is rotatably coupled, is affixed to a wall proximate a window at an approximate mid-vertical height of such window. An elongate cord having a first end fixed to the wall and another coupled to such winch member, encircles the drape. Upon actuate of the motor, adjustable timing means permits operation of the motor for a predetermined interval of time to allow the elongate cord to be wound onto such winch member, thereby causing the cord encircling the drape to constrict and thereby bunching the drape together thereby drawing it from the window. Reversal of the direction of the winch allows unwinding of the cord to thereby allow the drape to fall back into position thereby covering the window.

12 Claims, 7 Drawing Sheets

DRAPERY ACTUATOR SYSTEM AND METHOD OF OPERATION

FIELD OF INVENTION

The present invention relates to a drapery actuator system and method for opening and closing draperies and the like.

BACKGROUND OF THE INVENTION

Ordinarily, to open draperies, the draperies are manually moved along a drapery cord between open and closed positions. This, of course, effectively regulates the amount of natural light entering a room.

It is often desirable to have motorized drapery actuators to open and close draperies. Such drapery actuators typically have a drive pulley to engage a drapery cord which, in turn, engages draperies and the like. In this respect, actuation of the drive pulley opens and closes the draperies. The drapery actuator disclosed in U.S. Pat. No. 5,889,377 to the within inventor is one example of such a device.

Known motorized drapery actuator systems, such as those described in U.S. Pat. No. 4,958,112, include variably positional limit switch actuators 68 & 69 each mounted on a pull-cord bight 14 with parallel reaches 15,16, which trip respective limit switches 65 & 66 respectively which serve to prevent further movement of the curtain at the desired fully open position and fully closed position. Such a system is only adaptable to drapes having pull-cords. Moreover, such a system using limit switches cannot be readily applied to draperies which do not open and close by virtue of movement along a track, but rather are opened by tensioning a cord around the midsection of such draperies.

Other known devices, such as that disclosed in U.S. Pat. No. 4,131,831, disclose a timer 17. Such timers, such as the timer 17 disclosed in U.S. Pat. No. 4,131,831, are not used for adjustably positioning the desired open position of the drape [which in U.S. Pat. No. 4,131,831 is accomplished by limit switch 18], rather such timers (typically programmable over the course of a day) regulate when during the day to open and shut the drapes, rather than how long the motor is to be actuated, which as indicated above is governed by limit switches 18,19.

Accordingly, it is desirable to have a motorized drapery actuator apparatus or system which can be variably adjusted to effect opening drapes of various widths about their midsection.

SUMMARY OF THE INVENTION

In one of its broadest aspects the present invention comprises a drapery opening and closing system for opening and closing a drape, comprising:

(i) an electric motor, adapted to be affixed to a wall proximate a window therein at an approximate mid-vertical height of said window;

(ii) a winch member rotatably coupled to said motor;

(iii) an elongate cord member, having a first end adapted for fixation to said wall proximate said window at said mid-vertical height and a second end adapted to be coupled to said winch member, said winch member adapted for rotation to wind said cord member thereon and to permit unwinding of said cord member therefrom, said cord member intermediate its first and second ends adapted to form a loop for encircling said drape, said loop adapted to constrict when said second end is wound on said winch member so as to bunch together the encircled drape thereby pulling the drape away from the window;

(iv) actuation means for providing and deactivating electrical power to said motor; and (v) timing means, electrically coupled to said actuation means and said motor to permit timed operation of said motor in a given direction for a pre-determined interval of time to permit winding of said cord member on said winch member so as to open said drape, and to permit timed operation of said motor in an opposite direction for a pre-determined interval of time so as to permit unwinding of said cord member from said winch member.

In a preferred embodiment, the timing means provided with the drapery system of the present invention possesses adjustment means, preferably manual adjustment means, to permit adjustment of the predetermined interval of time for which the motor operates. This feature, in combination with the previously described drapery system, provides the important capability of the manufacturer of such a system being able to provide a single drapery system that can be manually modified at the time of installation to work with any size(ie width) of drape that may be present in a customers house. In particular, by providing the timing means as being adjustable, the aforementioned predetermined interval of time can be manually adjusted for the drapery system to permit the timing means to operate the motor for the precise amount of time that is necessary to wind the cord on the winch member and thereby pull the drape away from the window it is covering, and no longer. In a further embodiment, the electric motor is a constant speed motor, so that the predetermined interval of time necessary for the motor to be operated so as to wind the cord onto the winch and thus open the drape is precisely the same period of time necessary for the motor to be operated so that the cord becomes unwound from the winch member to as to allow that particular curtain to fall back into the closed position covering the window. Accordingly and advantageously, in the case where the motor is a constant speed motor, with one manual adjustment of the timing means for opening the drape the pre-determined interval for closing the drape will likewise have simultaneously been set.

In a further preferred embodiment of the drapery opening and closing system of the present invention, the components of the system are effectively "doubled" to allow the opening and closing of two half-member drapes. Such "doubled" system is particularly adapted for large windows, where two half-member drapes are employed for closing the window and which expose the window from the middle when opened. Accordingly, in such embodiment the present invention provides a drape opening and closing system for opening and closing two drape half-members, comprising:

(i) a pair of reversible electric motors, adapted to be affixed respectively proximate opposite side edges of a window each at an approximate mid-vertical height thereof;

(ii) a pair of winch members, respectively rotatably coupled to a respective motor;

(iii) a pair of elongate cord members, each having a first end adapted for fixation to said wall proximate a respective opposite side edge of said window at said mid-vertical height and a second end adapted to be coupled to a respective winch member, said winch members adapted for rotation to wind a respective cord member thereon and to permit unwinding of said respective cord member therefrom, said cord members intermediate each of their first and second ends adapted to form a loop member for encircling a respective drape half-member, said loop member adapted to constrict when said second end thereof is wound on said respective winch member so as to bunch together the encircled drape half-member thereby pulling the drape half-member away from a portion of the window which it covers;

(iv) actuation means for providing and deactivating electrical power to said motors; and (v) timing means, electrically coupled to said actuation means and said motors to permit timed operation of said motors in a given direction for a pre-determined interval of time to permit winding of said cord members on said respective winch members so as to open said drape half-member, and to permit timed operation of said motors in an opposite direction for a pre-determined interval of time so as to permit unwinding of said cord members from said respective winch members.

Likewise in such embodiment it is desirable that the pre-determined interval of time as determined by the timing means is adjustable, and the motors are constant speed motors.

In a preferred embodiment of either the single drape system or the two half-member drape system, to assist the drape or drapes to fall back into a position covering the window when the cord member is unwound, the drapery opening and closing system of the present invention further comprises weight means positionable proximate a lower side edge of a drape, moveable with such drape when such drape is opened and closed by the cord member, which due to gravity acting thereon when the drape is in the open position is adapted to assist the drape in returning to a closed position when the cord member is unwound from the winch member.

Lastly, a method for operating a drapery system to open and close a drape is provided, such system comprising:

(i) an electrically reversible constant speed motor secured to a wall proximate a window therein at an approximate mid-vertical height of said window, said motor having a winch member rotatably coupled thereto;

(ii) a first end of an elongate cord member affixed to said wall proximate said motor, a second end coupled to said winch member so as to form a loop member between said first and second end which encircles said drape about an approximate mid-portion thereof;

(iii) weight means, positioned proximate a lower side edge of said drape, moveable with said drape when said drape is opened and closed by said cord member, adapted to assist said drape in returning to a closed position when said cord member is unwound from said winch member;

said method comprising operating said motor to permit operation of said motor in a given direction for a pre-determined interval of time to permit winding of said cord member on said winch member so as to bunch together the encircled drape so as to pull the drape away from the window for said pre-determined interval of time.

The method for opening and closing a drape as set out above further comprises in a preferred embodiment the step of adjusting the pre-determined interval of time to be the interval of time for the cord member to become sufficiently wound on said winch member so that said drape is drawn a desired amount from the window.

When a constant speed motor is used, the pre-determined interval oftime to open the drapes will be the same interval of time to close the drapes. Accordingly the method of the present invention set out above further comprises the step of operating the motor for such pre-determined interval of time in a direction to permit unwinding of the cord member on the winch member so as to relax the cord encircling the drape so as to permit the drape to move back to a position of greater coverage of the window.

BRIEF DESCRIPTION OF THE DRAWINGS

The invention will be better understood when consideration is given to the following detailed description of preferred embodiments thereof. Such description makes reference to the annexed non-limiting drawings wherein.

DETAILED DESCRIPTION OF THE PREFERRED EMBODIMENTS

FIG. 1 and FIGS. 2–4 show two different embodiments of a drapery actuator system 10 of the present invention.

Figure 1:
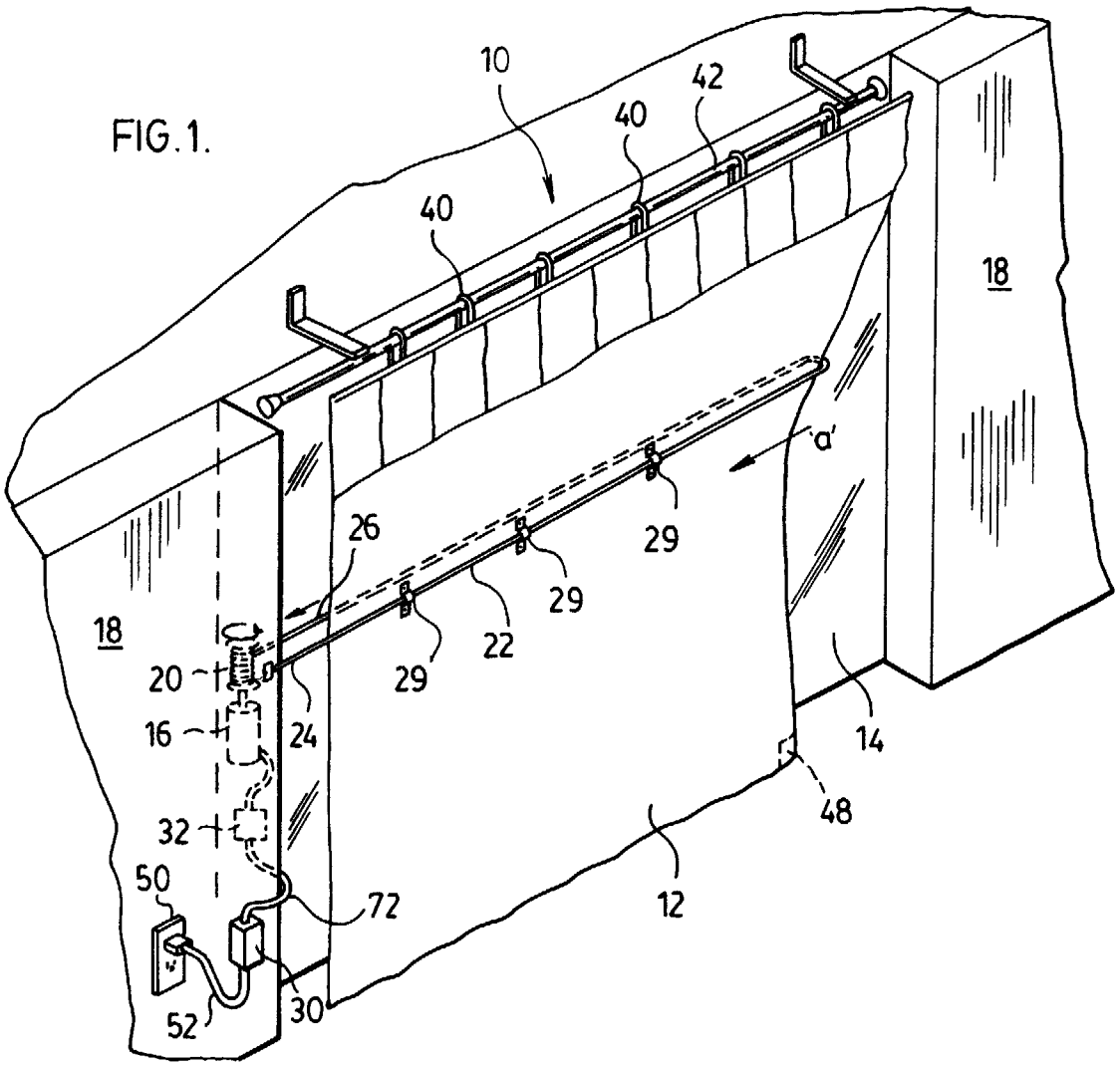
FIG. 1 is a perspective view of a first embodiment of the drape opening and closing system of the present invention.

FIG. 1 shows the drapery actuator system 10 of the present invention in one embodiment thereof applied for the purpose of opening and closing a single drape 12 covering a window 14 using automated means. Drapes 12 of the tape shown in FIG. 1 are typically hung on cleats 40 which slidably travel on a curtain rod 42 to allow removal of the drape 12 when covering a window 14. For the drapery operating system 10 of the present invention, at least one end of the drape 12 (in FIG. 1 the right-hand side of the drape 12) is fixedly attached to the curtain rod 42 to prevent the upper right-hand edge of the drape 12 from sliding on the curtain rod 42.

A reversible electric motor 16 is provided, which is adapted to be affixed to a wall 18, proximate the window 12. A rotatable drum or winch member 20 is rotatably coupled to the motor 16. An elongate cord member 22 is provided, having a first end 24 affixed to the wall 18, and a second end 26 adapted to be coupled to the winch member 20 by being wound thereon. The elongate cord member 22 intermediate its first 24 and second end 26 is adapted to form a loop 28 for encircling the drape 12 as shown in Fig. Locator loops 29 may further be stitched or sewn onto the drape 12 with the cord member 22 passed there through to maintain the cord member 22 in a desired position as shown in FIG. 1. Loop 28 is adapted to constrict when the second end 26 is wound on the winch member 20 so as to bunch together the encircled drape 12 so as to pull the curtain in the direction of arrow "a" thereby pulling the drape 12 away form the window 14.

Actuation means, in the preferred embodiment shown in FIG. 1 comprising of a manually-operated electrical switch 30, is provided. Alternatively, such switch 30 instead of being manually operable is a solenoid which is actuated by an infra-red or radio transmitter. In such case switch 30 further possesses means (not shown) permitting such switch to become actuated upon receiving a radio or infra-red signal from such transmitter (not shown). In a preferred embodiment the switch 30 further possesses means for reversing the direction of rotation of the motor 16 and winch member 20 thereon upon the drape 12 reaching the desired open position when electrical current is re-supplied to the motor when the switch 30 is re-actuated and the drape 12 is desired to be closed. The switch 30 is electrically coupled to a source of electrical power 50 by means of wires 52.

Timing means, namely a timer 32 electrically coupled to the switch 30 is provided (see FIGS. 1 and 7).The timer 32 permits current to flow to motor 16 for a pre-determined interval of time to permit winding the cord member 22 on the winch member so as to open the drape 12, and permit timed operation of the motor 16 in the opposite direction for a pre-determined interval of time so as to permit unwinding of the cord member 22 from the winch member 20. In a preferred embodiment the timer 32 possesses a knurled knob 44 to permit the pre-determined interval of time(ie the interval of time for the constant speed electrical motor 16 to wind the cord member 22 thereon so as to open the drape 12 to a desired position uncovering window 14) to be manually adjustable.

To assist the drape 12 in returning to a closed position when the cord member 22 is unwound from the winch member 20, a weight 48, typically a solid flat mass of metal in the approximate range of 5–25 ounces, is fixedly attached to the drape 12 proximate the lower right-hand edge of the drape 12, as shown in FIG. 1. When the drape 12 is drawn to a closed position, the weight 48 will become slightly raised in elevation, due to the lower right-hand edge ofthe drape 12 being drawn leftwards while the upper righthand edge remains fixedly coupled to curtain rod 42. Upon cord member 22 being unwound from winch member 20, the weight member 48 assists the lower right hand edge of the drape 12 (see FIG. 1) in returning to the right-hand side of the window 14 thereby closing the window 14.

Figure 2:
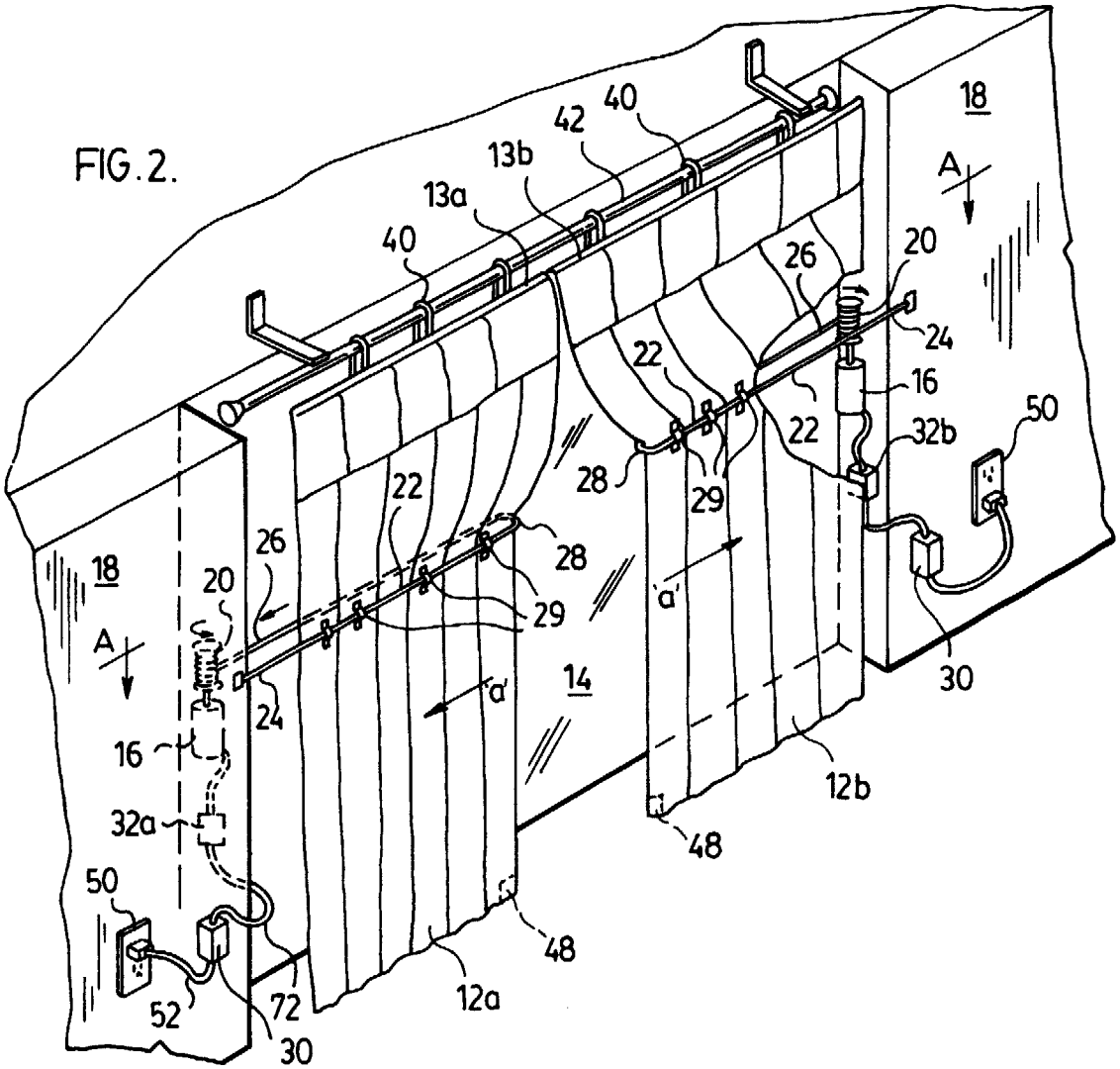
FIG. 2 is a is a perspective view of a first embodiment of the drape opening and closing system of the present invention.
Figure 3:
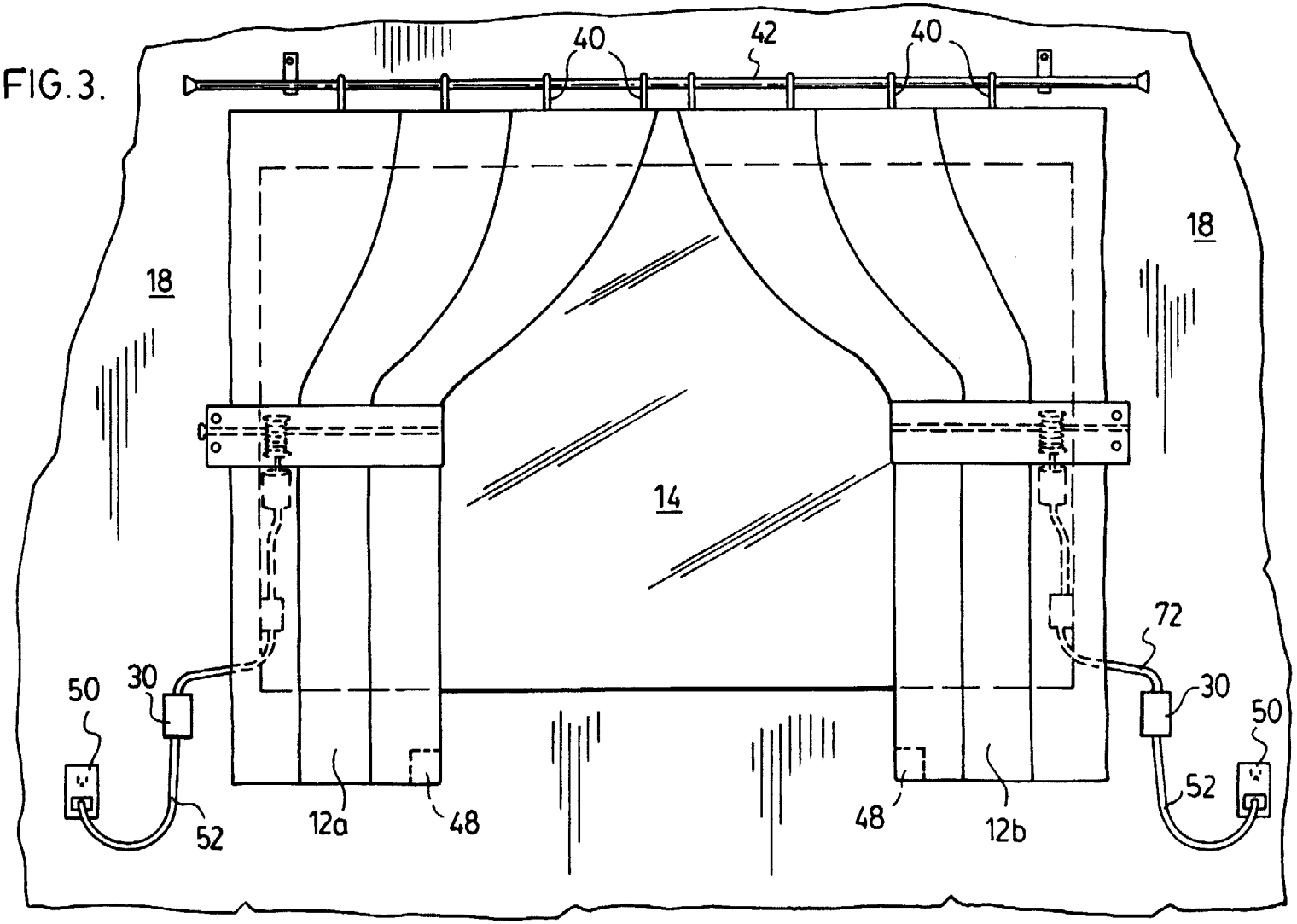
FIG. 3 is a front elevation view of a drapery opening and closing system shown in FIG. 2.
Figure 4:
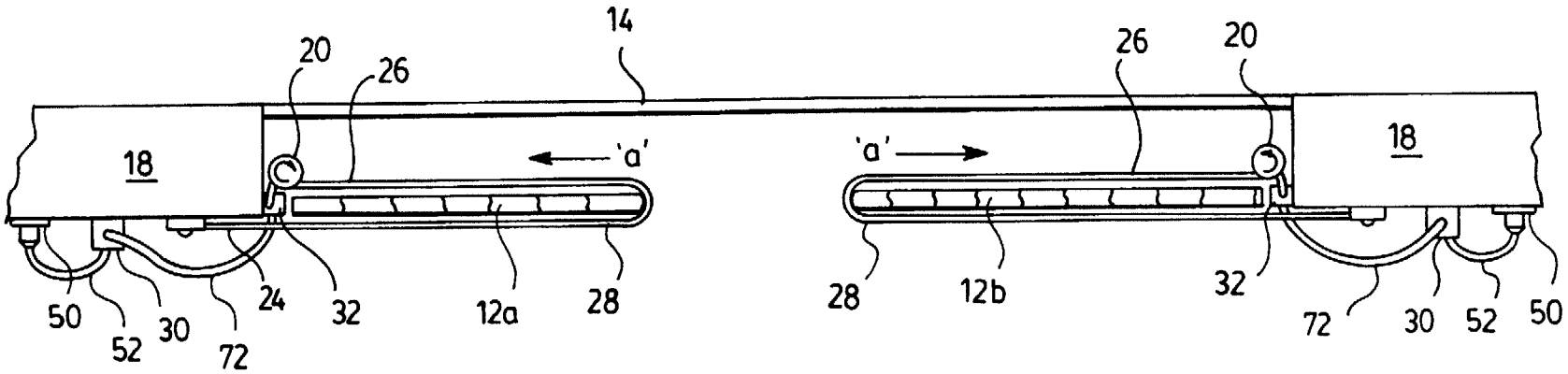
FIG. 4 is a top sectional plan view taken along plane A—A of FIG. 2.

FIGS. 2–4 show various views ofthe drapery opening and closing system 10 of the present invention adapted to open two drape half-members 12*a*, 12*b* suspended on a curtain rod 42 by cleats 40. Each drape half member 12*a*, 12*b* is attached to the other at their respective upper ends 13*a*, 13*b* as shown most clearly in FIG. 2. The drapery opening system in such embodiment is a "doubling" of the system 10 shown in FIG. 1, each drape half-member having an associated cord member 22, motor 16, winch member 20, switch 30, and timer 32. In a preferred embodiment, the two switches 30 are electrically coupled or in communication with each other, so that actuation of one will actuate the other. Alternatively only a single switch may be employed, electrically coupled to the two motors 16, to avoid having to operate two switches 30.

Figure 5:
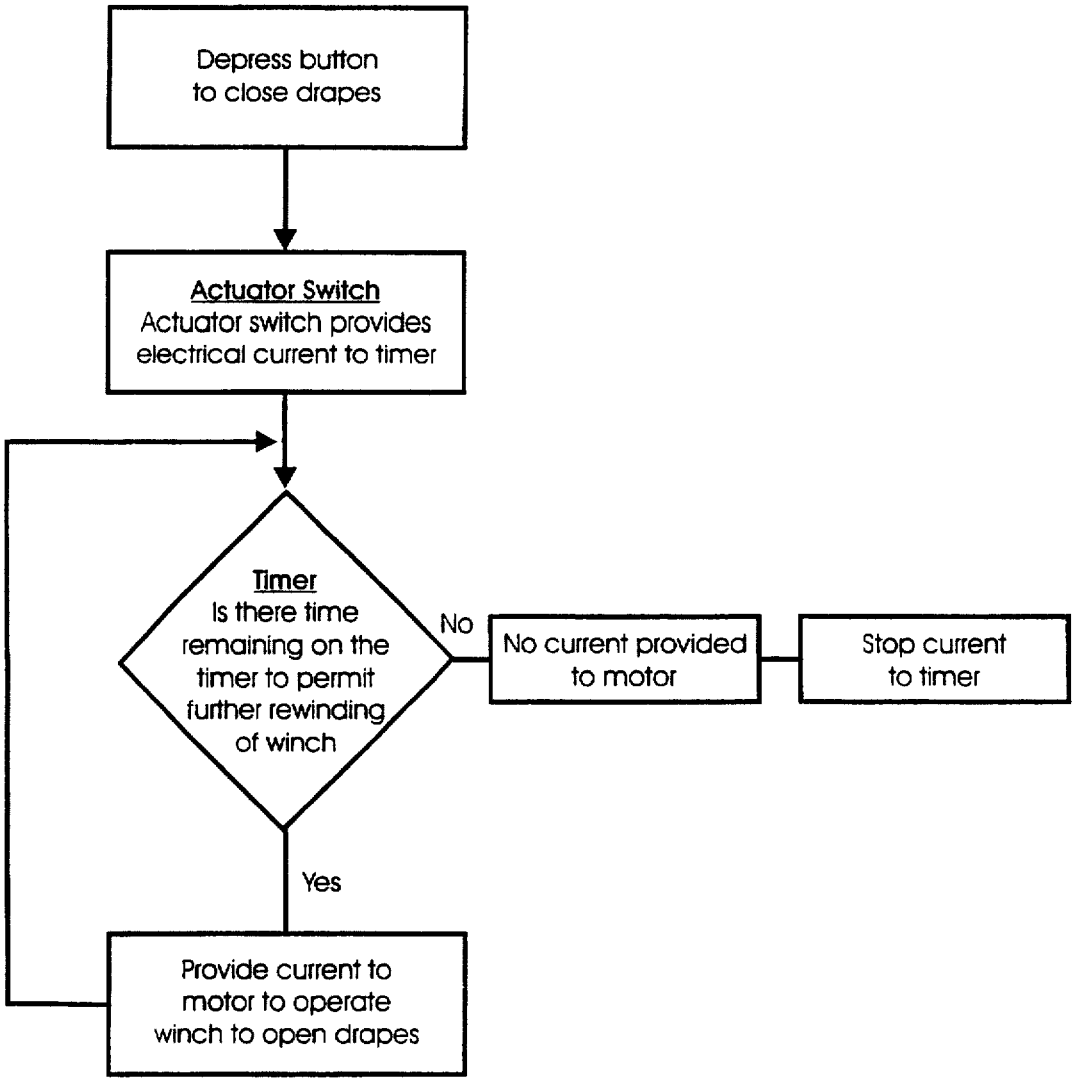
FIG. 5 is a schematic logic diagram for one broad aspect of the method of operating a drapery system of the present invention, showing a preferred sequence of events involved in the closing of a drape.
Figure 6:
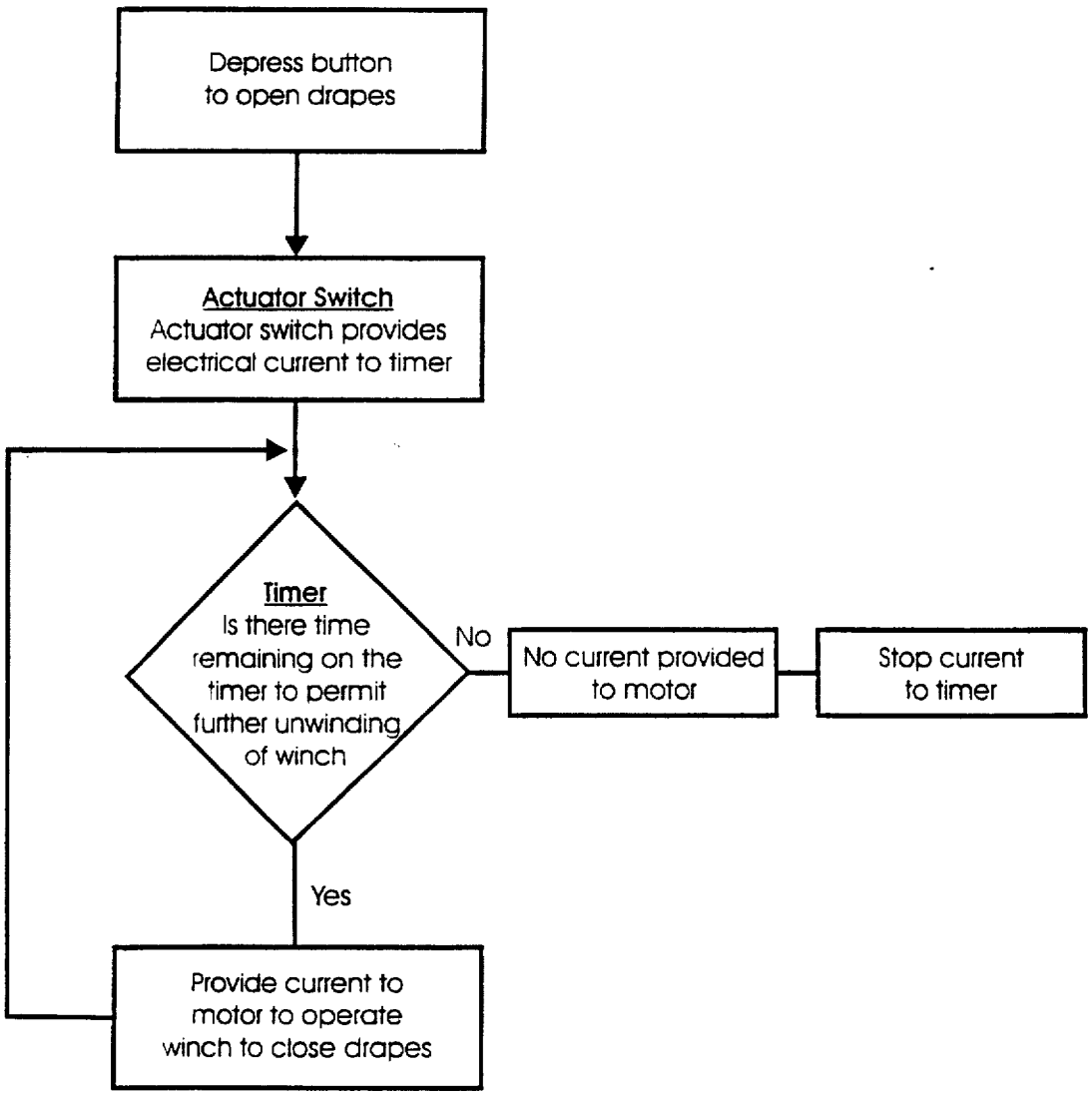
FIG. 6 is a schematic logic diagram for one broad aspect of the method of operating a drapery system of the present invention, showing a preferred sequence of events involved in the opening of a drape.

FIGS. 5 and 6 show a method for opening and closing the drapes 12, 12*a*, 12*b*, shown in FIGS. 1&2. For closing of the drape 12 (FIG. 1) or drapes 12*a*, 12*b* (FIG. 2), firstly a button, which may be a button on switch 30 or a button on a hand-held radio or infra-red transmitter, is depressed, which in turn actuates actuator switch 30 so as to provide electrical current to timer 32. Timer 32 has a pre-set interval of time for which it provides current to electric motor or motors 16. Upon expiry of such time, timer 32 stops further current from continuing to be supplied to such motor. Actuator means, namely switch 30 thereafter stops further current from being supplied to timer 32. Timer 32 resets itself, and switch 30 reverses the polarity of the electrical current supplied to the motor(s) 16, in preparation for the next actuation, which would be to open the drape 12 or drapes 12*a*, 12*b*.

Likewise FIG. 6 shows graphically in part the steps of the method of the present invention to open the drape 12 or drapes 12*a*, 12*b*. Firstly a button or lever, which may be a button or lever on switch 30 or a button or lever on a hand-held radio or infra-red transmitter, is depressed, which in turn actuates actuator switch 30 so as to provide electrical current to timer 32. Timer 32 has a pre-set interval of time for which it provides current to electric motor or motors 16. Upon expiry of such time, timer 32 stops further current from continuing to be supplied to such motor. Actuator means, namely switch 30 thereafter stops further current from being supplied to timer 32. Timer 32 resets itself, and switch 30 reverses the polarity of the electrical current supplied to the motor(s) 16, in preparation for the next actuation, which would be to close the drape 12 or drapes 12*a*, 12*b*.

Figure 7:
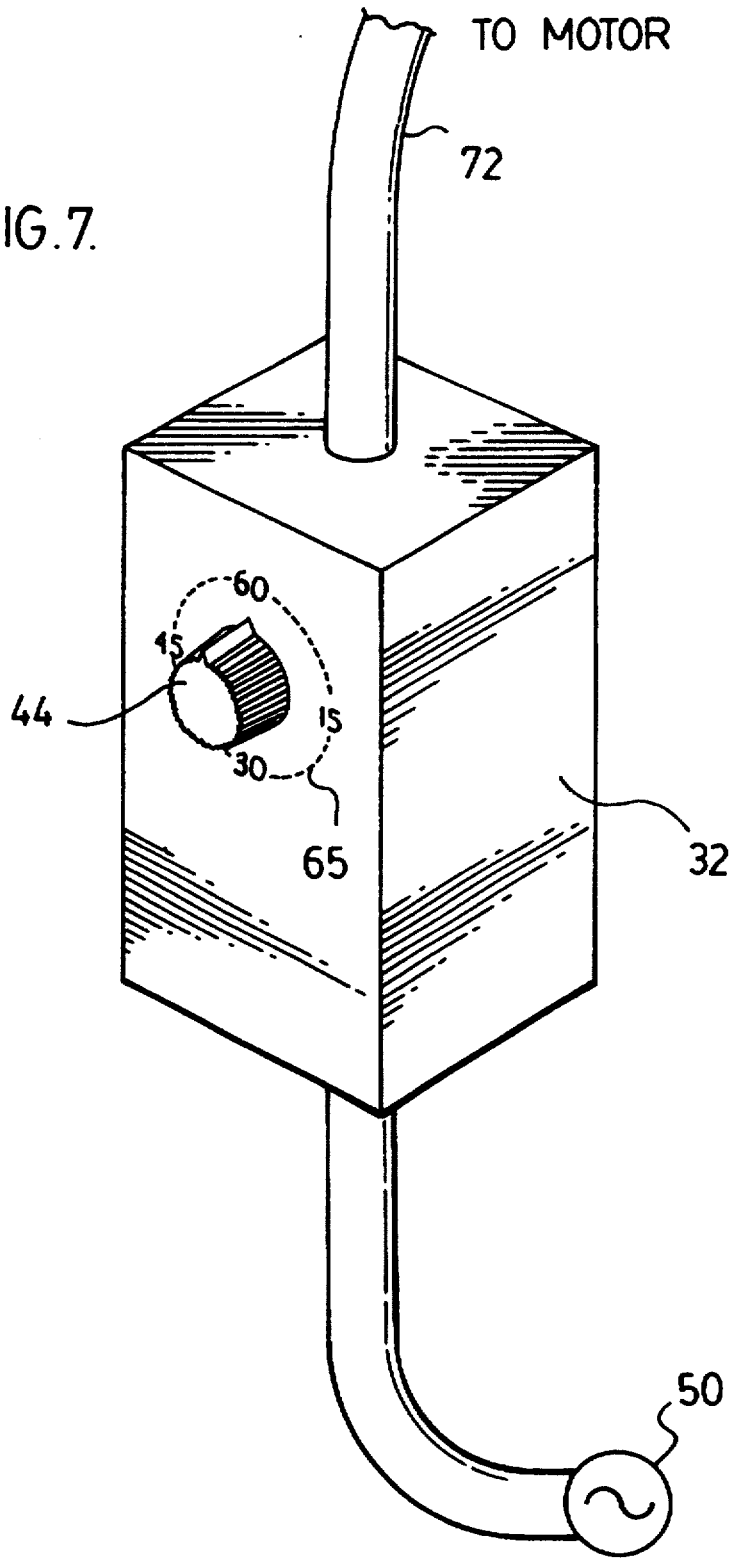
FIG. 7 is a perspective view of one type of commercially-available timer for use in the drapery opening and closing system of the present invention.

Referring to FIG. 7, such figure depicts a timer 32 for use with the drapery system 10 of the present invention. Such timer 32 is s a conventional unit well known in the art, and may include a manually adjustable knob 44 having time intervals 65 marked thereon, to allow adjustment of the pre-determined time interval for which current will be supplied to motor(s) 16 via wires 72 when current is supplied to such timer 32 via wires 52.

Alternatively, in an alternative embodiment the rotating knob 60 of timer 32 utilized in the drapery system 10 of the present invention may have markings (not shown) marked on the housing of such timer 32 corresponding to the positions of drapes 12*a* or 12*b*. The rotating knob 44 on the timer 32 can be rotated to thereby set the predetermined cumulative length of time the motor 16 or motors 16 remain in operation when current is supplied to timer 32 when switch 30 is actuated to close or open the drape 12 (FIG. 1) or drapes 12*a*, 12*b* (FIG. 2).

In the embodiment shown in FIG. 2 separate timers 32*a* and 32*b* are provided and associated with each of drapes 12*a* and 12*b*. In this respect, opening of each of drapes 12*a* and 12*b* can be controlled separately. For instance, drape 12*a* can be set to open to an intermediate open position whose distance from its respective closed position is different from the intermediate open position of drape 12*b*. Alternatively, a single timer 32 can be associated with each of drapes 12*a* and 12*b*. In this respect, movement of drapes 12*a* and 12*b* can be controlled by a single timer 32.

It will be understood that modifications can of course be made in the embodiments of the invention described herein without departing from the scope and purview of the invention as defined by the appended claims.

What is claimed is:

1. A drapery opening and closing system for opening and closing a drape, comprising:

a reversible electric motor, adapted to be affixed to a wall proximate a window therein at an approximate mid-vertical height of said window;

a winch member rotatably coupled to said motor;

an elongate cord member, having a first end adapted for fixation to said wall proximate said window at said mid-vertical height and a second end adapted to be coupled to said winch member, said winch member adapted for rotation to wind said cord member thereon and to permit unwinding of said cord member therefrom, said cord member intermediate its first and second ends adapted to form a loop for encircling said drape, said loop adapted to constrict when said second end is wound on said winch member so as to bunch together the encircled drape thereby pulling the drape away from the window;

actuation means for providing and deactivating electrical power to said motor; and timing means, electrically coupled to said actuation means and said motor to permit timed operation of said motor in a given direction for a pre-determined interval of time to permit winding of said cord member on said winch member so as to open said drape, and to permit timed operation of said motor in an opposite direction for a pre-determined interval of time so as to permit unwinding of said cord member from said winch member.

2. The drapery opening and closing system as claimed in claim 1, wherein said pre-determined interval of time is adjustable.

3. The drapery opening and closing system as claimed in claim 1, wherein said motor is a constant speed motor.

4. The drapery opening and closing system as claimed in claim 1, further comprising weight means positionable on a lower corner of said drape proximate a vertical side edge of said drape which is horizontally moveable, said weight means moveable with said drape and said vertical side edge thereof and adapted to assist said drape when said drape is in an open position to return to a closed position when said drape is desired to be returned to a closed position.

5. The drapery opening and closing system as claimed in claim 1, further comprising electrical switch means for reversing the direction of rotation of the motor and winch member there on upon the drape reaching the desired open position when electrical current is re-supplied to said motor when said drape is subsequently desired to be closed.

6. A drape opening and closing system for opening and closing two drape half-members, comprising:

a pair of reversible electric motors, adapted to be affixed respectively proximate opposite side edges of a window each at an approximate mid-vertical height thereof;

a pair of winch members, respectively rotatably coupled to a respective motor;

a pair of elongate cord members, each having a first end adapted for fixation to said wall proximate a respective opposite side edge of said window at said mid-vertical height and a second end adapted to be coupled to a respective winch member, said winch members adapted for rotation to wind a respective cord member thereon and to permit unwinding of said respective cord member therefrom, said cord members intermediate each of their first and second ends adapted to form a loop member for encircling a respective drape half-member, said loop member adapted to constrict when said second end thereof is wound on said respective winch member so as to bunch together the encircled drape half-member thereby pulling the drape half-member array from a portion of the window which it covers;

actuation means for providing and deactivating electrical power to said motors; and timing means, electrically coupled to said actuation means and said motors to permit timed operation of said motors in a given direction for a pre-determined interval of time to permit winding of said cord members on said respective winch members so as to open said drape half-member, and to permit timed operation of said motors in an opposite direction for a pre-determined interval of time so as to permit unwinding of said cord members from said respective winch members.

7. The drapery opening and closing system as claimed in claim 6, wherein said pre-determined interval of time is adjustable.

8. The drapery opening and closing system as claimed in claim 6, wherein said motors are constant speed motors.

9. The drapery opening and closing system as claimed in claim 6, further comprising a pair of weight members, each positionable on a lower corner of a respective drape half-member, proximate a vertical side edge thereof which is horizontally moveable, each of said weight means moveable with a corresponding respective drape half-member and vertical side edge and adapted to assist a respective drape half-member when in an open position in returning to a closed position when said drape half member is desired to be returned to a closed position.

10. A method for operating a drapery system to open and close a drape, said system comprising:

an electrically reversible constant speed motor secured to a wall proximate a window therein at an approximate mid-vertical height of said window, said motor having a winch member rotatably coupled thereto;

a first end of an elongate cord member affixed to said wall proximate said motor, a second end coupled to said winch member so as to form a loop member between said first and second end which encircles said drape about an approximate mid-portion thereof;

a weight member, positioned proximate a lower side edge of said drape, moveable with said drape when said drape is opened and closed by said cord member, adapted to assist said drape in returning to a closed position when said cord member is unwound from said winch member; said method comprising:

operating said motor to permit operation of said motor in a given direction for a pre-determined interval of time to permit winding of said cord member on said winch member so as to bunch together the encircled drape so as to pull the drape away from the window for said pre-determined interval of time.

11. The method for opening and closing a drape as claimed in claim 10, further comprising the step of adjusting the pre-determined interval of time to be the interval of time for the cord member to become sufficiently wound on said winch member so that said drape is drawn a desired amount from the window.

12. The method for opening and closing a drape as claimed in claim 10, further comprising the step of:

operating said motor for said pre-determined interval of time in a direction to permit unwinding of said cord member on said winch member so as to relax the cord encircling said drape so as to permit the drape to move back to a position of greater coverage of the window.

* * * * *